United States Patent [19]

Conway et al.

[11] Patent Number: 4,938,365

[45] Date of Patent: Jul. 3, 1990

[54] LITERATURE DISPLAY BOX

[75] Inventors: Gerald A. Conway, Cleveland, Ohio; Kin G. Cheng, Hong Kong, Hong Kong

[73] Assignee: Gerald Conway & Company, Cleveland, Ohio

[21] Appl. No.: 142,231

[22] Filed: Jan. 11, 1988

[51] Int. Cl.[5] ..... A47F 7/00

[52] U.S. Cl. ..... 211/50; 211/175

[58] Field of Search ..... 211/50, 43, 85, 175; 248/448

[56] References Cited

U.S. PATENT DOCUMENTS

| | | | |
|---|---|---|---|
| 593,120 | 11/1897 | Putnam | 248/448 |
| 593,935 | 11/1897 | Hall | 248/448 |
| 2,624,466 | 1/1953 | Ramsay | 211/43 |
| 2,810,483 | 10/1957 | Kalhorn | 211/50 |
| 3,850,303 | 11/1974 | Franklin | 211/43 X |

*Primary Examiner*—Blair M. Johnson

*Attorney, Agent, or Firm*—Renner, Otto, Boisselle & Sklar

[57] ABSTRACT

A literature display box for supporting literature on a horizontal surface includes a center and two end parts which interfit with the center part so that they may be adjusted laterally to provide lateral expansion or contraction of the box. The back and bottom of the center part are provided with guide tracks which interfit with fingers or tines projecting from the end parts. Interengaging stops preclude separation of the parts but include cam surfaces facilitating assembly. The parts include rearwardly extending legs cooperating with the lower front edge of the center part to support the display box inclined somewhat rearwardly on a horizontal surface. The parts are preferably made of durable molded plastic.

20 Claims, 3 Drawing Sheets

LITERATURE DISPLAY BOX

DISCLOSURE

This invention relates generally as indicated to a literature display box for supporting and displaying literature on a horizontal surface, and more particularly to a literature display box which may be expanded and contracted to accommodate literature of different sizes.

BACKGROUND OF THE INVENTION

Literature display boxes are often employed on horizontal surfaces such as desks, shelves, tables or ticket counters to display sales or informative literature. Unfortunately such literature comes in a variety of sizes ranging from pocket size pamphlets or folders to full letter size with various sizes in between. An example of a pocket size item would be an airline schedule or a credit card application form while an example of a full letter size publication would be a sales catalog. Moreover, publications from one edition to another sometimes change sizes.

To support and display such literature then requires a variety of sizes of display box. This in turn creates an ordering and inventorying problem for the user. It would therefore be desirable to have a literature display box which could quickly be adjusted to accommodate literature of different sizes.

SUMMARY OF THE INVENTION

A literature display box for supporting literature on a horizontal surface includes a center and two end parts which interfit with the center part so that they may be adjusted laterally to provide lateral expansion or contraction of the box. The back and bottom of the center part are provided with guide tracks which interfit with fingers or tines projecting from the end parts. Interengaging stops preclude separation of the parts but include cam surfaces facilitating assembly. The parts include rearwardly extending legs cooperating with the lower front edge of the center part to support the display box inclined somewhat rearwardly on a horizontal surface. The parts are preferably made of durable molded plastic.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENTS

Figure 1:
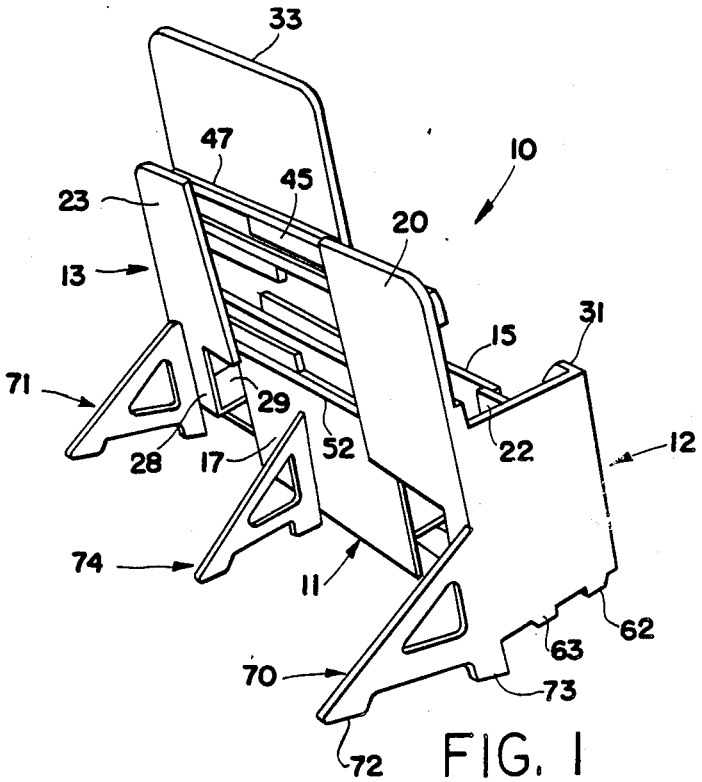
FIG. 1 is a rear perspective of a literature display box in accordance with the present invention shown expanded.

Referring now to the drawings and more particularly to FIGS. 1–6 there is illustrated a literature display box 10 in accordance with the present invention. The display box comprises a center part 11 and opposite end parts 12 and 13 which when assembled with the center part form the display box 10.

Figure 4:
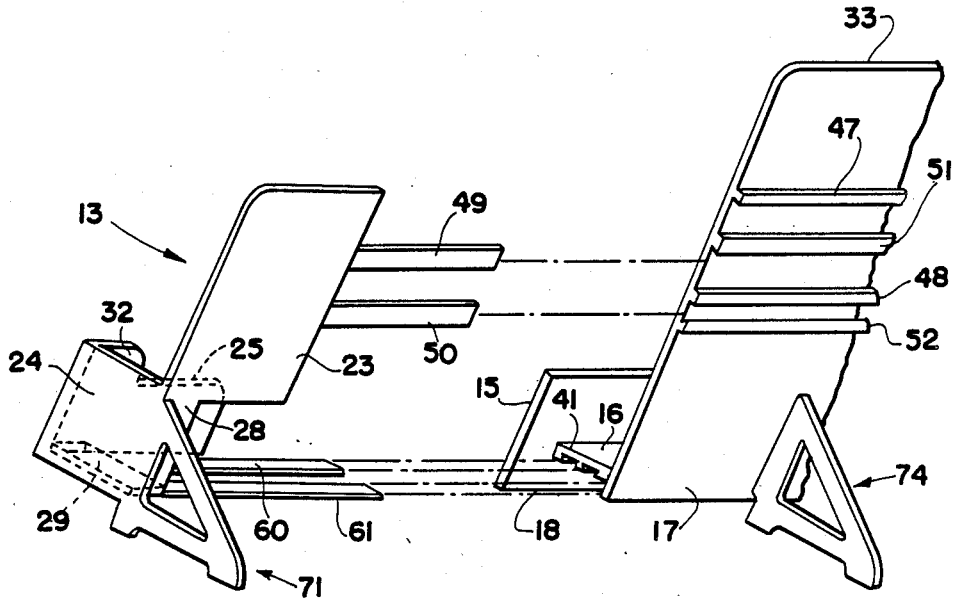
FIG. 4 is an exploded rear perspective showing one end and the center part with the latter being broken away.
Figure 5:
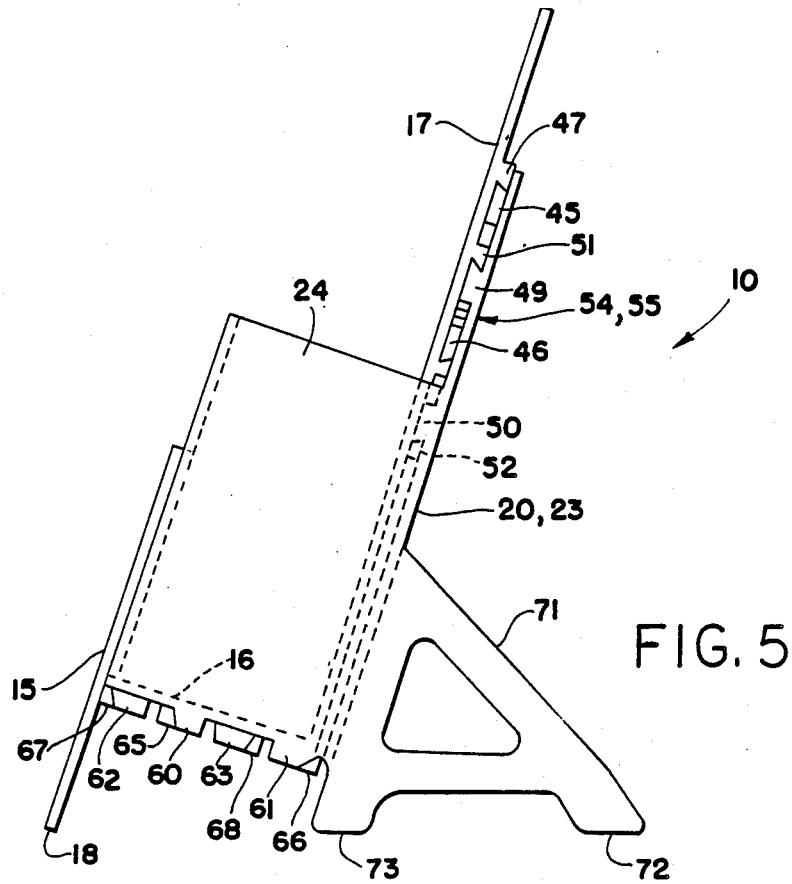
FIG. 5 is an enlarged end elevation of the box.

The center part includes a front wall 15, and a bottom wall 16, the latter seen better in FIGS. 4 and 5. Also as seen more clearly in FIGS. 4 and 5, the lower edge 18 of the front wall 15 of the center part extends well below the bottom wall 16 of the center part which is normal to the front and rear walls.

The end part 12 includes a rear wall 20, an end wall 21 and a front wall 22. Similarly, the end part 13 includes a rear wall 23, an end wall 24 and a front wall 25. The upper edges of the front walls 22 and 25 are height coextensive with the upper edge 26 of the front wall 15 of the center part. Each rear wall 20 and 23 of the end parts 12 and 13, respectively, includes a downwardly extending more narrow portion seen at 27 and 28 which forms a projecting flange on the rear of the end walls 21 and 24, respectively. Such flanges continue across the bottom of each end part as seen at 29 in FIGS. 1 and 4, such bottom flanges joining the front, rear and end walls.

The end walls 21 and 24 of the end parts are somewhat higher than the front walls and at each front corner the front walls are provided with corner extensions 31 and 32 having rounded interior corners, which extensions are the same height as the end walls. While the end walls of the end parts are higher than the front walls, the rear walls 20 and 23 are higher still but nonetheless well below the top edge 33 of the rear wall 17 of the center part.

Figure 2:
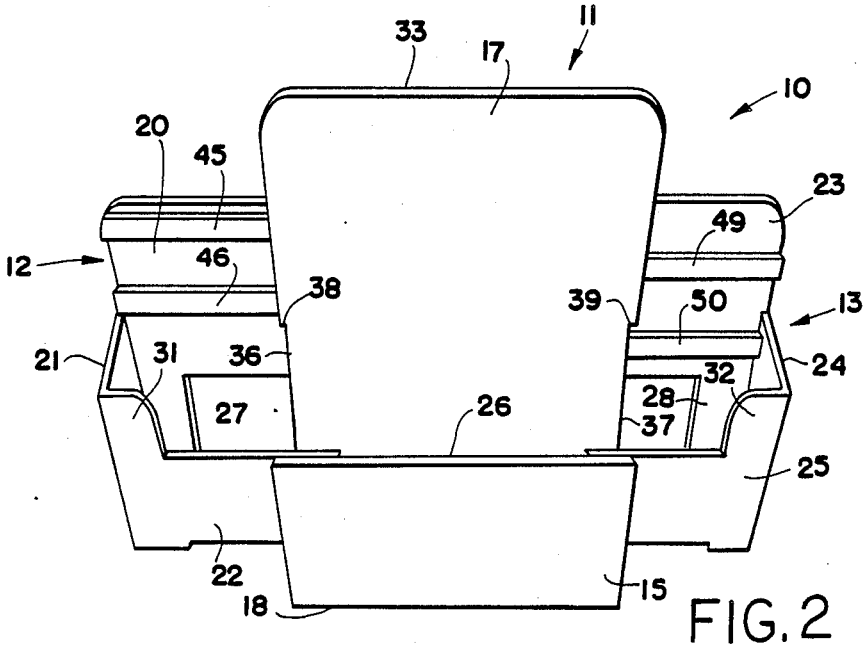
FIG. 2 is a front perspective of the display box also shown expanded.
Figure 3:
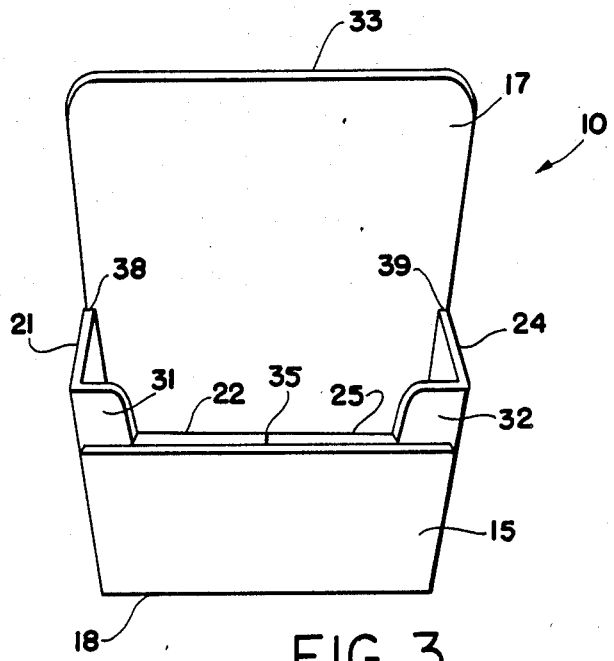
FIG. 3 is a similar front perspective of the display box but shown contracted.

As seen more clearly in FIGS. 2 and 3 the front walls 22 and 25 of the end parts fit closely behind the front wall 15 of the center part and when the box is fully contracted such front walls abut each other in the center as indicated at 35 in FIG. 3. When the box is fully contracted as seen in FIG. 3 the end walls 21 and 24 of the end parts abut the lower edges 36 and 37 of the center wall 17 of the center part. Such lower edges are slightly inwardly offset as indicated by the steps 38 and 39 in the side edges of the center part center wall 17 which fit closely over the top edges of the end walls of the end parts. Also, when the display box is fully contracted, the bottom flanges 29 of the end parts abut the end edges 41 of the bottom wall 16 of the center part, such end edges of the bottom wall of the center part being recessed inwardly from the edges of the front and rear walls of the center part for this purpose. The rear walls 20 and 23 of the end parts telescope behind the rear wall 17 of the center part.

Secured to the front of the rear wall 20 of the end part 12 are two horizontally projecting fingers or tines 45 and 46 which serve as rails guiding the end part 12 for horizontal movement in tracks 47 and 48, respectively, in the back of the rear wall 17 of the center part. Similarly, the rear wall 23 of the end part 13 is provided on its front with fingers or tines 49 and 50 which serve as rails guiding the end part 13 in tracks 51 and 52 also on the back of the rear wall 17 of the center part. As seen more clearly in FIG. 5, the lower edges of the tracks 47 and 51 are slightly undercut while the upper edges of the tracks 48 and 52 are also slightly undercut mating with corresponding beveled edges on the fingers or tines. The fingers or tines projecting from the respective rear walls of the end part are vertically offset to engage the lateral edges of the respective tracks and are of course offset from each other.

Figure 6:
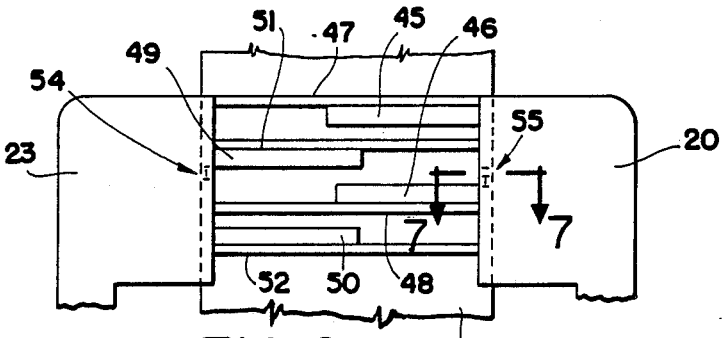
FIG. 6 is a fragmentary rear elevation showing the interfitting tracks and fingers on a somewhat reduced scale.
Figure 7:
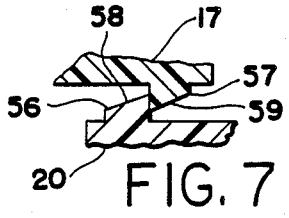
FIG. 7 is an enlarged fragmentary horizontal section of one of the stops as seen from the line 7—7 of FIG. 6.

As seen more clearly in FIGS. 6 and 7, the tine 49 projecting from the rear wall 23 and the tine 46 projecting from the rear wall 20 are vertically offset from each other and in such space at the inner edge of the rear walls of the outer parts, and at the outer edge of the rear wall of the center part there is provided interengaging stops at the locations indicated generally at 54 and 55. Such stops comprise interengaging projections 56 and 57 each of which includes outwardly extending inclined cam surfaces seen at 58 and 59. When the parts are assembled the cam fingers permit the projections to ride over the tops of each other and snap into the position shown. In such position, as the two end parts are pulled outwardly, the abutting larger end faces of the projections will engage as shown preventing the end parts from being completely disassembled from the center part.

Referring now to FIGS. 1, 4 and 5 it will be seen that each end part includes a set of fingers or tines which engage in tracks on the bottom of bottom wall 16 of the center part. Such fingers or tines are secured to and project inwardly from the bottom flanges 29 of each center part. The end part 13 includes fingers or tines 60 and 61 while the end part 12 includes fingers or tines 62 and 63. The lateral edges of the tines 60 and 61 away from each other are beveled and fit in undercut tracks seen at 65 and 66 in FIG. 5 which are on the bottom of the bottom wall 16 of the center part. Similarly, the edges of the tines 62 and 63 which are away from each other fit in undercut tracks 67 and 68. The tracks and tines thus provide a gib type sliding connection between the end parts and the center part.

As seen more clearly in FIGS. 1, 4 and 5, the end parts 12 and 13 are provided with triangular rear extensions seen at 70 and 71, respectively. The triangular extensions each includes spaced feet 72 and 73. The outer side of such extensions forms a continuation of the end walls. A similar triangular extension 74 is provided in the center of the lower end of the rear wall 17 of the center part. The feet of each extension are in the same horizontal plane and also in the same horizontal plane as the lower edge 18 of the front wall 15 of the center part. In this manner the display box can be positioned on a horizontal surface to tilt slightly rearwardly as indicated in FIGS. 1 and 5.

The box is preferably injection molded of a suitable smooth finish durable plastic material so that each of the parts of the three separate parts are all integrally formed. In any event the literature display box of the present invention can quickly be converted from a display box for displaying pocket sized pamphlets and the like to a display box for displaying full letter size literature, and vice versa.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A three part literature display box for displaying literature on a counter, shelf or the like comprising a center part having a front wall, a bottom wall and a back wall, a rear portion of said bottom wall meeting with a lower portion of said back wall, said front wall being upstanding from said bottom wall, said center part being open at each end, and two end parts each having an end wall, a front, and back wall, and means mounting said end parts on said center part for telescoping movement toward and away from each other to expand and contract the lateral width of the box, with the front walls of said end parts telescoping adjacent and rearwardly of the upstanding front wall of said center part.

2. A display box as set forth in claim 1 wherein said front walls of said end parts are half the width of said front wall of said center part.

3. A display box as set forth in claim 1 wherein said front and rear walls of said end parts are half the width of said front and rear walls of said center part.

4. A display box as set forth in claim 1 wherein the bottom of the bottom wall of said center part includes laterally extending guide tracks and each end part includes laterally inwardly extending tines engaging said tracks.

5. A display box as set forth in claim 1 wherein the back of the back wall of said center part includes laterally extending guide tracks, and each end part includes laterally inwardly extending tines engaging said tracks.

6. A display box as set forth in claims 4 or 5 wherein at least some of said guide tracks are undercut with the corresponding tine fitting within the undercut.

7. A display box as set forth in claims 4 or 5 wherein the tines projecting from one end part are offset from the tines projecting from the other end part.

8. A display box as set forth in claim 5 wherein said tines extend along the entire front of said rear walls of said end parts.

9. A display box as set forth in claim 1 including projecting stops on said center and end parts precluding complete disassembly of said parts upon expansion.

10. A display box as set forth in claim 2 wherein the front and back walls of said end parts abut each other when said box is contracted.

11. A display as set forth in claim 1 wherein both said front and rear walls of said end parts slide adjacent but rearwardly of the front and rear walls of said center part.

12. A display as set forth in claim 1 wherein said three parts are formed of molded plastic.

13. A three part literature display box for displaying literature on a counter, shelf or the like comprising a center part having a front wall, a bottom wall and a back wall, said center part being open at each end, and two end parts each having an end wall, a front, and back wall, means mounting said end parts on said center part for telescoping movement toward and away from each other to expand and contract the lateral width of the box, and wherein the bottom of the bottom wall of said center part includes laterally extending guide tracks, and each end part includes laterally inwardly extending tines engaging said tracks, said laterally inwardly extending tines being secured to the bottom of a narrow inwardly extending bottom flange on the bottom of said end wall of said end parts.

14. A display box as set forth in claim 13 wherein said bottom flange of said end parts abuts the lateral edges of said bottom wall of said center part and forms a continuation thereof in the contracted condition of said box.

15. A three part literature display box for displaying literature on a counter, shelf or the like comprising a center part having a front wall, a bottom wall and a back wall, said center part being open at each end, and two end parts each having an end wall, a front, and back wall, means mounting said end parts on said center part for telescoping movement toward and away from each other to expand and contract the lateral width of the box, and projecting stops on said center and end parts precluding complete disassembly of said parts upon expansion, said projecting stops including cam surfaces to facilitate assembly of the parts.

16. A three part literature display box for displaying literature on a counter, shelf or the like comprising a center part having a front wall, a bottom wall and a back wall, said center part being open at each end, and two end parts each having an end wall, a front, and back wall, means mounting said end parts on said center part for telescoping movement toward and away from each other to expand and contract the lateral width of the box, and wherein said front wall of said center part is relatively shorter than said back wall of said center part and the top edge of said front wall of said center part is horizontally aligned with the top edges of said front walls of said end parts.

17. A display box as set forth in claim 16 wherein the lower edge of said front wall of said center part extends below the lower edge of the front walls of said end parts, said lower edge of said front wall of said center part serving as a support for said box.

18. A display box as set forth in claim 17 wherein the upper edge of said rear wall of said center part projects substantially above the upper edges of said rear walls of said end parts, and the lower edge of said rear wall of said center part is substantially coextensive with the lower edges of said rear, end and front walls of said end parts.

19. A display box as set forth in claim 18 including legs extending downwardly and rearwardly of said rear walls of said center and end parts to support said box in conjunction with the lower edge of said front wall.

20. A display box as set forth in claim 19 wherein the lower ends of said legs are arranged to support said box inclined rearwardly on a horizontal surface.

* * * * *